US012643706B2

(12) United States Patent
Dammers et al.

(10) Patent No.: US 12,643,706 B2
(45) Date of Patent: Jun. 2, 2026

(54) PACKAGE SLEEVE, PACKAGE AND METHOD FOR MANUFACTURING A PACKAGE

(71) Applicant: SIG Services AG, Neuhausen am Rheinfall (CH)

(72) Inventors: Matthias Dammers, Alsdorf (DE); Birgit Birninger, Linnich (DE); Christoph Mehler, Moenchengladbach (DE); Thomas Vetten, Duesseldorf (DE)

(73) Assignee: SIG Services AG, Neuhausen am Rheinfall (CH)

( * ) Notice: Subject to any disclaimer, the term of this patent is extended or adjusted under 35 U.S.C. 154(b) by 144 days.

(21) Appl. No.: 16/087,844

(22) PCT Filed: Mar. 16, 2017

(86) PCT No.: PCT/EP2017/056197
§ 371 (c)(1),
(2) Date: Sep. 24, 2018

(87) PCT Pub. No.: WO2017/174316
PCT Pub. Date: Oct. 12, 2017

(65) Prior Publication Data

US 2019/0337664 A1 Nov. 7, 2019

(30) Foreign Application Priority Data

Apr. 4, 2016 (DE) ..... 10 2016 003 824

(51) Int. Cl.
*B65D 3/00* (2006.01)
*B65D 3/08* (2006.01)
(Continued)

(52) U.S. Cl.
CPC ..... *B65D 3/08* (2013.01); *B65D 5/0209* (2013.01); *B65D 5/029* (2013.01); *B65D 5/064* (2013.01);
(Continued)

(58) Field of Classification Search
CPC ..... B65D 3/08; B65D 5/0209; B65D 5/029; B65D 5/064; B65D 5/4266; B65D 5/746; B65D 5/40
(Continued)

(56) References Cited

U.S. PATENT DOCUMENTS 2,550,520 A * 4/1951 Bennett ..... B65D 31/02 138/DIG. 6
3,049,277 A * 8/1962 Shappell ..... B65D 3/22 220/DIG. 14
(Continued)

FOREIGN PATENT DOCUMENTS

BR 112018069462 A2 2/2019
CN 1244484 A 2/2000
(Continued)

*Primary Examiner* — Peter N Helvey
(74) *Attorney, Agent, or Firm* — The Webb Law Firm

(57) ABSTRACT

Provided is a package sleeve made of a composite material for the manufacture of a package. The package sleeve includes a sleeve surface with an inner partial area and two outer partial areas, a longitudinal seam connecting two edges of the composite material to form a circumferential package sleeve, and two secondary fold lines running through the sleeve surface. The package sleeve is folded along two secondary fold lines. Apart from the two secondary fold lines, the package sleeve does not contain any further continuous fold lines in the region of the inner partial area of the sleeve surface. Also provided are a package and a method for manufacturing a package.

12 Claims, 11 Drawing Sheets

(51) Int. Cl.

| | |
|---|---|
| ***B65D 5/02*** | (2006.01) |
| ***B65D 5/06*** | (2006.01) |
| ***B65D 5/42*** | (2006.01) |
| ***B65D 5/74*** | (2006.01) |
| *B65D 5/40* | (2006.01) |

(52) U.S. Cl.
CPC ..... *B65D 5/4266* (2013.01); *B65D 5/746* (2013.01); *B65D 5/40* (2013.01)

(58) Field of Classification Search
USPC ..... 229/106
See application file for complete search history.

(56) References Cited

U.S. PATENT DOCUMENTS 3,058,868 A * 10/1962 Schroeder ..... B29C 66/02245 156/254
3,254,827 A * 6/1966 Chapman ..... B65D 5/4279 229/148
3,279,675 A * 10/1966 Elam ..... B65D 3/22 229/4.5
3,333,515 A * 8/1967 McGlynn ..... D21J 7/00 493/379
3,369,727 A * 2/1968 Wright ..... B65D 5/061 229/248
3,411,692 A 11/1968 Mathews
3,495,507 A * 2/1970 La Bombard ..... B29C 65/02 229/137
3,633,814 A 1/1972 Michetti et al.
3,654,842 A * 4/1972 Schwenk ..... B29C 66/43122 493/287
3,716,435 A * 2/1973 Jensen ..... B29C 66/135 156/190
3,827,623 A 8/1974 Arneson
4,124,159 A * 11/1978 Schwarzkopf ..... B65D 5/061 229/249
4,711,797 A * 12/1987 Niske ..... B24B 1/00 493/287
4,760,949 A * 8/1988 Elias ..... B29C 66/1122 428/35.9
4,787,507 A 11/1988 Rausing
4,991,768 A 2/1991 Kondo
5,067,613 A * 11/1991 Bryan ..... B65D 5/068 229/214
5,207,632 A * 5/1993 Brunlid ..... B31B 50/00 493/287
5,221,346 A * 6/1993 Anderson ..... B05C 5/0204 118/410
5,598,927 A 2/1997 Ikenoya et al.
5,660,326 A * 8/1997 Varano ..... B65D 3/22 493/907
5,738,272 A 4/1998 Anchor et al.
6,042,527 A 3/2000 Anderson et al.
6,085,970 A * 7/2000 Sadlier ..... B65D 3/22 493/907
D436,032 S * 1/2001 Croft ..... D9/416
D468,638 S * 1/2003 Nogami ..... D9/423
6,554,182 B1 * 4/2003 Magnusson ..... B65D 5/563 493/134
D540,164 S * 4/2007 Franic ..... D9/434
7,934,637 B2 5/2011 Kaneko
10,870,508 B2 12/2020 Garitz et al.
2004/0011688 A1 1/2004 Ishikawa
2004/0169066 A1 * 9/2004 Palm ..... B65D 5/067 229/110
2005/0199692 A1 9/2005 Nelson et al.
2005/0236463 A1 10/2005 Boldrini et al.
2006/0255110 A1 11/2006 Kaneko
2008/0296359 A1 12/2008 Kortsmit et al.
2009/0145951 A1 * 6/2009 Bone ..... B65D 5/18 229/4.5
2011/0113733 A1 5/2011 Franic
2011/0230321 A1 9/2011 Alef et al.
2011/0303739 A1 * 12/2011 Franic ..... B65D 5/746 229/125.04
2012/0279182 A1 11/2012 Barbieri et al.
2014/0033653 A1 * 2/2014 Cham ..... B29C 66/92651 156/379.6
2016/0031587 A1 * 2/2016 Franic ..... B65D 5/067 229/125.15
2016/0137374 A1 * 5/2016 Brosch ..... B65D 33/007 383/104
2016/0176601 A1 * 6/2016 Boekeloo ..... B65D 75/5844 206/457
2016/0332795 A1 11/2016 Mainz
2016/0376045 A1 12/2016 Seiche
2019/0106239 A1 4/2019 Dammers et al.
2019/0337664 A1 11/2019 Dammers et al.
2022/0135305 A1 * 5/2022 Bazbaz ..... B65D 33/02 383/207
2022/0347961 A1 * 11/2022 Evans ..... B29C 65/087

FOREIGN PATENT DOCUMENTS

CN 1525923 A 9/2004
CN 1671599 A 9/2005
CN 1759042 A 4/2006
CN 206766540 U 12/2017
DE 3343629 A1 6/1985
DE 4036454 A1 5/1992
DE 4237859 A1 5/1994
DE 202004010230 U1 11/2004
DE 102009024318 A1 6/2010
EP 00127350 A1 4/1981
EP 0144736 A2 6/1985
EP 0226248 A2 6/1987
EP 0684184 A2 11/1995
EP 1080880 A1 3/2001
EP 1332969 A1 8/2003
EP 0936150 B1 4/2004
EP 2392517 A1 12/2011
GB 374757 A 6/1932
GB 419077 11/1934
GB 808223 1/1959
GB 1243812 A 8/1971
JP 11-91727 A 4/1999
JP 2001-213427 A 8/2001
JP 2002-67192 A 3/2002
JP 2004-224411 A 8/2004
JP 2010-18283 A 1/2010
WO 9732787 A2 9/1997
WO 2008147499 A1 12/2008
WO 2009030910 A2 3/2009
WO 2009101029 A1 8/2009
WO 2009141389 A2 11/2009
WO 2015003852 A9 1/2015
WO 2015104234 A1 7/2015

* cited by examiner

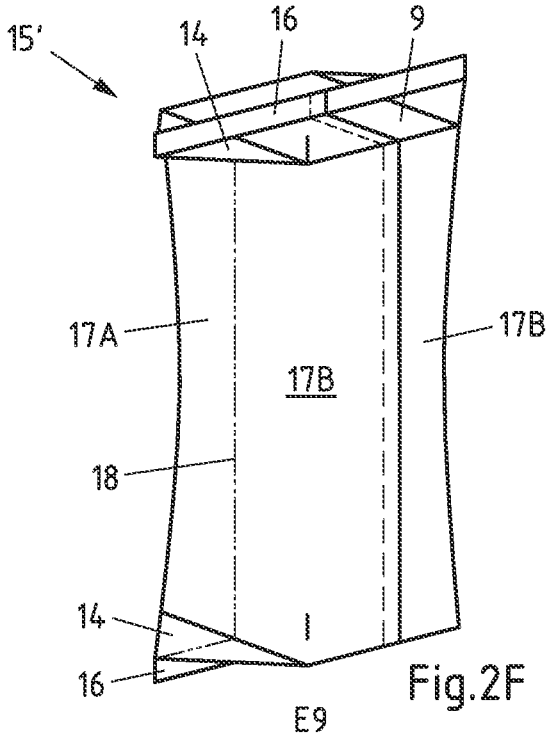
Fig.2F
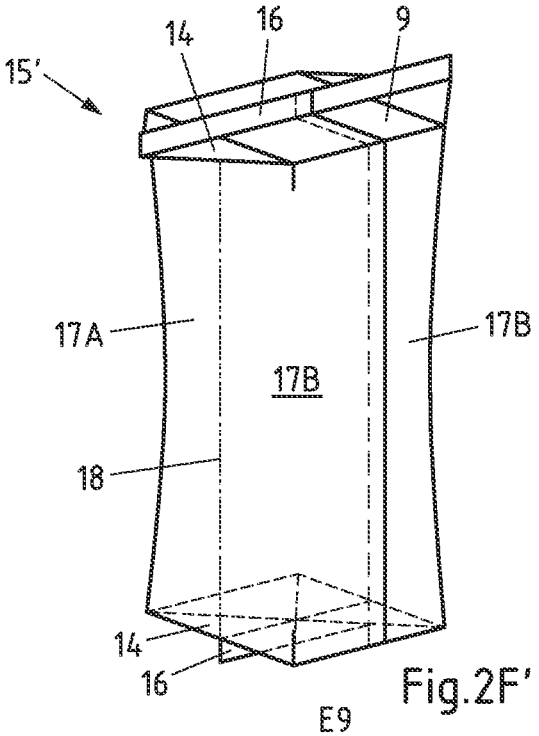
Fig.2F'
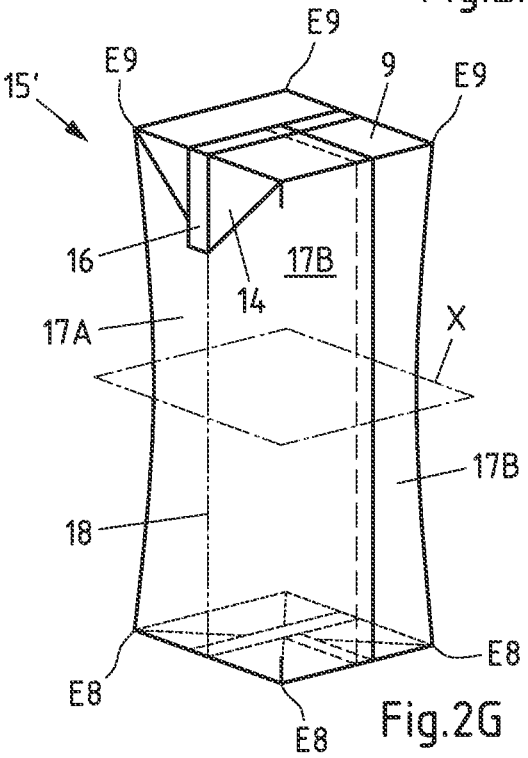
Fig.2G
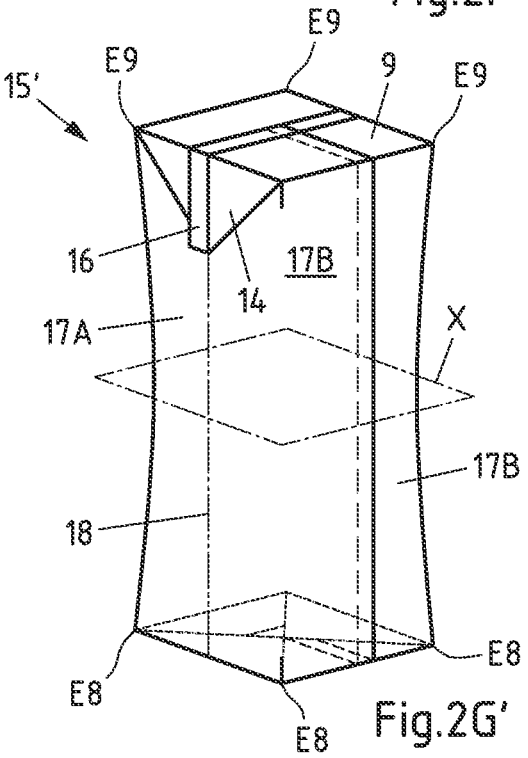
Fig.2G'
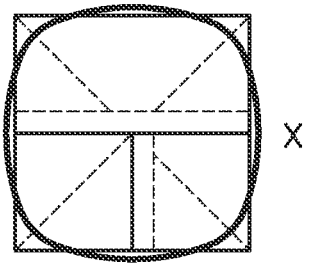
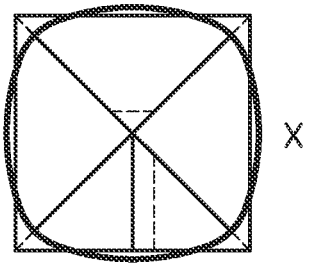

PACKAGE SLEEVE, PACKAGE AND METHOD FOR MANUFACTURING A PACKAGE

CROSS-REFERENCE TO RELATED APPLICATIONS

This application is the United States national phase of International Application No. PCT/EP2017/056197 filed Mar. 16, 2017, and claims priority to German Patent Application No. 10 2016 003 824.1 filed Apr. 4, 2016, the disclosures of which are hereby incorporated in their entirety by reference.

BACKGROUND OF THE INVENTION

Field of the Invention

The invention relates to a package sleeve made of a composite material for the manufacture of a package, comprising: a sleeve surface with an inner partial area and with two outer partial areas, a longitudinal seam which connects the two edges of the composite material to form a circumferential package sleeve, and two secondary fold lines which run through the sleeve surface, wherein the package sleeve is folded along both secondary fold lines.

The invention further relates to a package made of a composite material, wherein the package is made from a package sleeve as described above, and wherein the package is sealed in the region of the base surfaces and in the region of the gable surfaces.

Finally, the invention relates to a method for manufacturing a package from a package sleeve made of a composite material.

Description of Related Art

Packages can be manufactured in different ways and from an extremely wide range of materials. A widely used possibility for their manufacture consists of producing a sleeve blank from the package material from which, through folding and further steps, first a package sleeve and finally a package is produced. This manufacturing method has the advantage, among others, that the sleeve blanks and package sleeves are very flat and can thus be stacked, saving space. In this way, the sleeve blanks or package sleeves can be manufactured in a different location to that where the folding and filling of the package sleeves takes place. Composite materials are frequently used as material, for example a composite material consisting of several thin layers of paper, paperboard, plastic or metal, in particular aluminium. Such packages are widely used in the foodstuffs industry in particular.

A first manufacturing step frequently involves producing a circumferential package sleeve from a sleeve blank through folding and welding or adhesive bonding of a seam. The folding of the sleeve blank usually takes place along pre-stamped fold lines. The location of the fold lines thereby corresponds to the location of the edges of the package which is to be produced from the package sleeve. This has the advantage that the sleeve blank and the package sleeve are exclusively folded at points at which the finished package is folded in any case. In the context of the present application, a sleeve blank refers to a sheet, manufactured from a composite material product produced on a roll, cut to size in a longitudinal and transverse direction and with a defined outline ("planar composite"). A package sleeve is subsequently manufactured from the sheet or planar composite and finished ready for sale, wherein a package sleeve is regarded as being ready for sale if, possibly following removal from an outer packaging provided for transport from the place of manufacture to the place of use, it is ready for processing in a filling machine intended for this purpose. This means in particular that the package sleeve requires no further mechanical interventions in order to guarantee smooth processing of the package sleeve on the filling machine intended for this purpose. In contrast, conditioning to the outer atmosphere and/or (additional) sterilisation (for example the applicant's edge sterilisation method) can also be carried out, optionally, on a finished package sleeve during or following transport to the intended place of use. On the other hand, intermediate steps occurring during the manufacture of the package sleeve from a sleeve blank involving forming and sealing cannot yet be described as relating to a package sleeve. A method for manufacturing a package from a package sleeve is for example known from WO 2015/003852 A9 (in particular, FIG. 1A to FIG. 1E). The package described therein has a rectangular cross-sectional profile and is generally cuboid in form.

As well as packages with rectangular cross-sectional profiles, packages are also known with cross-sectional profiles which have more than four corners. For example, packages with octagonal cross-sectional profile are known from EP 0 936 150 B1 or U.S. Pat. No. 6,042,527. The form of the packages is achieved in that additional fold lines are provided in the sleeve blanks.

However, one disadvantage of folding the package sleeves along the later package edges is that only packages with tangular cross-sectional profiles can be manufactured. Moreover, only packages with a cross-sectional profile which remains identical in the vertical direction of the package can be manufactured. In contrast, alternative designs, for example rounded edges or free forms instead of the edges, are not possible.

Package sleeves ("sleeves") and packages manufactured from these ("containers") are also known from EP 0 027 350 A1. The package sleeve described therein allows packages to be manufactured the cross-sectional profile of which changes in a vertical direction (rectangular cross-sectional profiles on the gable and at the base, octagonal cross-sectional profile in between). However, this package too has exclusively angular cross-sectional profiles. Alternative designs, for example rounded edges or free forms instead of the edges, are also not described in EP 0 027 350 A1. Moreover, the package sleeve described therein does not consist of composite material, but of paperboard or corrugated board. In order to fill the container with liquid, an inner pouch made of plastic is suggested, so that the package sleeve itself need not itself be suitable for manufacturing a liquid-tight package.

Package sleeves and packages manufactured from these are also described in GB 808,223 A. Here, a long material web of paperboard is first provided with fold lines and then covered with a plastic layer (FIG. 6). After creating a longitudinal seam (FIG. 7), the material web is opened up to form a tube with a rectangular cross section (FIG. 8). The two side surfaces of the tube are then folded inwards, as a result of which the tube assumes a flat form (FIG. 9). Transversely oriented seams are created at specific intervals, along which the tube can be folded and a stack thus formed (FIG. 10). By separating the tube in the region of the transversely oriented seams, individual package sleeves are obtained which are already sealed at one end—through the transversely oriented seam. One disadvantage of this approach is that the package sleeves are already folded along six fold lines on being separated from the tube, four of these fold lines forming the edges of the later package. These package sleeves too are therefore only suitable for manufacturing packages with rectangular cross-sectional profiles. Moreover, the freedom of design of the gable or base surface created in the region of the already sealed transverse seam are severely limited. Particularly disadvantageous are the high forming forces which are necessary in order to open up and form the package sleeve into a package open at one end (this intermediate state is also described as a "beaker"). The high forming forces lead to a considerable load on the already-sealed seams, so that a liquid- and/or gas-tightness is no longer provided with adequate certainty.

A further package sleeve and a package manufactured from this are described in WO 97/32787 A2. However, in this package sleeve too, numerous fold lines are provided in the region of the sleeve surface, some of which form the later edges of the package produced from this. These package sleeves too are therefore only suitable for the manufacture of packages with tangular cross-sectional profiles which remain identical in a vertical direction. A further disadvantage is that the package sleeve is not only sealed in the region of the rear side through a longitudinal seam, but is also already sealed in the region of the base through a transverse seam. This leads to a limited freedom of design of the base. Here too, the high forming forces which are necessary in order to open up and form the package sleeve into a package open at one end are particularly disadvantageous. The high forming forces lead to a considerable load on the already-sealed seams, so that a liquid- and/or gas-tightness is no longer provided with adequate certainty. Also disadvantageous is the limitation that only one base variant (lugs folded beneath the base) is possible, whereas a different base variant (lugs directed inwards above the base) is not possible.

SUMMARY OF THE INVENTION

Against this background, the invention is based on the problem of developing the package sleeve described and explained in detail above in such a way that the manufacture of packages—in particular liquid-tight packages—with complex geometry is made possible.

This problem is solved, in a package sleeve according to the preamble of claim 1, in that, apart from the two secondary fold lines, the package sleeve does not contain any further continuous fold lines in the region of the inner partial area of the sleeve surface.

The package sleeve according to the invention consists of a composite material and is used to manufacture a package. In particular, the package sleeve can consist of a composite of several thin layers of paper, paperboard, plastic or metal, in particular aluminium. Preferably, the package sleeve is formed as a single part. The package sleeve comprises a sleeve surface with an inner partial area and with two outer partial areas which, in a package sleeve produced therefrom, replace the front surface, the rear surface and the two side surfaces. The package sleeve also comprises a longitudinal seam which joins two edges of the composite material to form a circumferential package sleeve. The longitudinal seam allows a continuous package sleeve, closed in a circumferential direction, to be manufactured from a flat—in most cases rectangular—blank. The longitudinal seam can for example be produced through adhesive bonding and/or welding. Because of the longitudinal seam, such package sleeves are also referred to as longitudinally sealed package sleeves. The package sleeve also contains two secondary fold lines which run through the sleeve surface. The secondary fold lines are intended—like conventional fold lines—to facilitate the folding of the package sleeve. Secondary fold lines can be created through material weakenings. Since the packages are supposed to be liquid-tight, the material weakenings used are not perforations but so-called "creases". Creases are linear material displacements which are impressed into the composite material by means of pressing tools. The package sleeve is folded along both secondary fold lines. The sleeve surface is divided by the secondary fold lines into an inner partial area and two outer partial areas. The inner partial area lies between the two secondary fold lines and the outer partial areas lie next to and outside of the two secondary fold lines. The inner partial area of the sleeve surface forms the front side of the package sleeve and the two outer partial areas of the sleeve surface together form the rear side of the package sleeve.

According to the invention, apart from the two secondary fold lines, the package sleeve does not contain any further continuous fold lines in the region of the inner partial area of the sleeve surface. In other words, the package sleeve should not contain any further continuous fold lines in the area between the two secondary fold lines. Preferably, apart from the two secondary fold lines, the package sleeve does not contain any further continuous fold lines within the entire region of the sleeve surface.

This invention is thus based on the idea of not folding the package sleeve along fold lines which form the edges of the package produced from the package sleeve. That is to say the package sleeve is not folded along the fold lines which divide the front surface, the rear surface and the two side surfaces from one another. Instead, true fold lines are dispensed with, at least in the region of the inner partial area of the sleeve surface—but preferably within the region of the entire sleeve surface—and the package sleeve is exclusively folded along "secondary fold lines" which do not later form an edge of the package. A folding along the secondary fold lines therefore only takes place in the case of the package sleeve, but not in the case of the package produced from this. This permits a free design of the package geometry and in particular allows the manufacture of packages with package cross sections in a vertical direction which, at least in sections, are non-rectangular. In particular, it is possible to manufacture packages with curved surfaces without fold edges. "Continuous" fold lines refers to fold lines which cross through the whole sleeve surface, for example from the base surfaces to the gable surfaces. Preferably, apart from the two secondary fold lines, the package sleeve does not contain any further fold lines at least in the region of the inner partial area of the sleeve surface, and preferably within the entire region of the sleeve surface.

According to one embodiment of the package sleeve, the package sleeve is folded flat along both secondary fold lines by an angle of in each case around 180°. The package sleeve is folded flat along the secondary fold lines in such a manner that a front section and a rear section of the package sleeve lie on top of one another. This folding by an angle of around 180° makes possible particularly flat package sleeves. This allows package sleeves to be stacked in a space-saving manner, which facilitates transport for example. In this way, the package sleeves can be manufactured in a different location to that at which the filling and manufacture of the packages takes place. Preferably, the package sleeve is folded outwards along both secondary fold lines.

According to a further embodiment of the package sleeve, the two secondary fold lines run parallel to one another. The two secondary fold lines are straight and preferably run parallel to one another. This parallel arrangement has the advantage that the secondary fold lines can be stamped into the composite material particularly simply. A further advantage of the parallel arrangement of the secondary fold lines is that the package sleeve can be manufactured from a rectangular sleeve blank and that no complicated geometries (for example trapezoidal sleeve blanks) are necessary.

A further embodiment of the package sleeve is characterised by base surfaces and gable surfaces which are arranged on opposite sides of the sleeve surface. Preferably, the gable surfaces are—in a standing package—arranged above the sleeve surface and the base surfaces are arranged beneath the sleeve surface.

In connection with this embodiment of the package sleeve, it is further suggested that the base surfaces and the gable surfaces in each case comprise two rectangular surfaces and six triangular surfaces. Preferably, the rectangular surfaces and the triangular surfaces are also surrounded or limited by fold lines. The rectangular surfaces serve the purpose of folding the base and the gable of the package. The triangular surfaces are used to fold the surplus composite material into projecting "lugs" which are then laid against the package.

In this connection it is further suggested that the secondary fold lines run through the point of contact of three adjacent triangular surfaces of the base surface and through the point of contact of three adjacent triangular surfaces of the gable surfaces. This arrangement of the secondary fold lines has the advantage that the secondary fold lines run through the base surface and the gable surface at a point at which these surfaces need to be folded in any case, for example in order to form "lugs". The folding of the package sleeve along the secondary fold lines therefore already leads to a "pre-folding" of the fold line running centrally through the "lugs". A further advantage of the central arrangement of the secondary fold lines is that the secondary fold lines limit the scope for the design of the edge regions of the package as little as possible. It can be the case that two of the triangular surfaces of the base surface and/or the gable surface have roughly the same surface area. Alternatively, it can be the case that all three triangular surfaces of the base surface and/or the gable surface have different surface areas.

According to a further embodiment of the package sleeve, the length of the gable surface on the rear side of the package sleeve is less than the length of the gable surface on the front side of the package sleeve. This design leads to the front surface of the package having a lower height than the rear surface of the package. The package thus has a downward-sloping upper side.

According to a further embodiment of the package sleeve, the secondary fold lines are stamped from the inner side to the outer side of the package sleeve and/or from the outer side to the inner side of the package sleeve. Depending on the location and folding direction of a fold line, a change in the stamping direction can lead to better folding results. Moreover, in this way, outward-facing and raised lines—not intended for folding—can be created simultaneously, or in the same production step as the secondary fold lines, serving for example to allow the package to be gripped better and held more securely. A combination of two stamping directions can be used in the package sleeve.

In a further embodiment of the package sleeve it is suggested that the composite material of the package sleeve has a weight in the range between 150 g/m$^2$ and 400 g/m$^2$, in particular between 200 g/m$^2$ and 250 g/m$^2$. A grammage or weight within this range has proved to be a good compromise between low costs and low weight (thinnest possible composite material) and sufficient mechanical properties (thickest possible composite material).

According to a further embodiment of the package sleeve, the composite material includes at least one layer of paper or paperboard which is covered on the edge of the longitudinal seam running within the package sleeve. The covering of the paper layer or paperboard layer has the purpose of preventing any contact between the contents of the package and this layer. This serves on the one hand to prevent liquid from leaking out through the—not liquid-tight—paper layer or paperboard layer and on the other hand to protect the contents of the package against contamination through the paper layer or paperboard layer (for example pulp fibres).

In connection with this embodiment it is further suggested that the layer of paper or paperboard is covered by a sealing strip and/or by turning over the composite material in the region of the longitudinal seam. One possibility for achieving said covering involves the attachment of a separate sealing strip. The sealing strip can for example be made from the same material as the innermost layer of the composite material and can be glued or welded to this layer. Another possibility for covering involves turning or folding over the composite material in the region of the longitudinal seam. In this way, not all layers, but only the innermost layer of the composite material now appears on the edge of the longitudinal seam running within the package sleeve. However, the innermost layer must in any case be made of a material which is suitable for contact with the contents of the package.

In a further embodiment of the package sleeve, the composite material is stripped in the region of the longitudinal seam. A "stripped" composite material is understood to mean a composite material which has fewer layers in the stripped region than in the other regions. Particularly in the region where several material layers overlap, stripping brings the advantage of a less pronounced increase in thickness. The use of stripped composite material is therefore particularly advantageous if the composite material is turned or folded over—for example in the region of the longitudinal seam.

According to a further embodiment, the package sleeve can be supplemented with a material weakening, in particular a coated hole, in one of the gable surfaces for fixing a pouring element. The material weakening serves to facilitate the later attachment of a pouring element. For this purpose, a hole is for example first punched through the composite material, which is then coated over. The coating can for example be carried out with a plastic foil, and serves to seal the package until application of the pouring element.

According to a further embodiment of the package sleeve, the package sleeve is open both in the region of the base surfaces and also in the region of the gable surfaces. In other words, the package sleeve has two openings, one opening being arranged in the region of the base surface and the other opening being arranged in the region of the gable surface. The two opposite openings make it possible for the package sleeve to be opened out particularly simply, creating the form of a tube or sleeve. One advantage of package sleeves which are open at both ends—in contrast to WO 97/32787 A2 for example—lies in the variable design possibilities for the base. In particular, the orientation of the "lugs" can be chosen freely. A base variant can for example provide for the lugs to be folded under the rectangular surfaces of the base and fixed in place there. Another base variant can, in contrast, have inward-pointing lugs which are arranged above the rectangular surfaces of the base which are folded in later.

The problem described above is also solved through a package made of a composite material, wherein the package is manufactured from a package sleeve, and wherein the package is sealed in the region of the base surfaces and in the region of the gable surfaces. The package is characterised in that the package does not contain any continuous straight fold edges in the region of the inner partial area of the sleeve surface. Preferably, apart from the two secondary fold lines, the package does not contain any further continuous fold lines within the entire region of the sleeve surface.

Since the package is manufactured from one of the package sleeves described above, many properties and advantages of the package sleeve are also found in the package. One particular advantage is that the package has no tangular fold edges, at least in the region of the inner partial area of its sleeve surface, but preferably within the region of its entire sleeve surface, even though it was manufactured from a package sleeve which is folded in two places. This is achieved in that the package sleeve is "folded back" along the two secondary fold lines during the manufacture of the package, so that the partial areas of the sleeve surface adjoining the secondary fold lines once again merge continuously into one another. The secondary fold lines thus do not form the edges of the package, but lie—scarcely visible—within the sleeve surface of the package. Instead of straight, angular fold edges, a package with an individually formed, for example curved sleeve surface, is obtained. In particular, it can be the case that the package contains no fold edges at all, at least in the region of the inner partial area of its sleeve surface, but preferably within the region of the entire sleeve surface. The package preferably has a volume in the range between 50 ml and 4000 ml, in particular between 250 ml and 350 ml. Preferably, the package is formed as a single part. In particular, the part of the package made of the composite material is in any case preferably formed as a single part. This part of the package can be supplemented with further elements, for example with a pouring element (for example a plastic flip cap or screw cap) or a drinking aid (for example a drinking straw).

According to one embodiment of the package, the partial areas of the sleeve surface adjoining the secondary fold lines are in each case arranged in an angular range between 160° and 200°, in particular between 170° and 190° relative to one another. A particular advantage of this embodiment is that the package does not have any fold edges and thus rectangular edges on its sides. This is achieved in that the package sleeve is "folded back" along the two secondary fold lines during the manufacture of the package, so that the partial areas of the sleeve surface adjoining the secondary fold lines are arranged in roughly the same plane.

A further embodiment of the package is characterised through lugs which are laid against the base surfaces in the lower region of the package. Alternatively or additionally, the package is characterised through lugs which are laid against the sleeve surface in the upper region of the package. In the lower region of the package, the lugs can be laid against the base surface in different ways: in one base variant, the lugs are folded under the rectangular surfaces of the base and fixed in place there. Another base variant can, in contrast, have inward-pointing lugs which are arranged above the rectangular surfaces of the base which are folded in later. The first variant has the advantage that the lugs are pressed securely against the package through the dead weight of the filled package, whereas the second variant offers a particularly smooth base surface. The arrangement of the upper lugs on the sleeve surface has the advantage that a pouring element can be arranged on the upper side of the package.

The problem described above is also solved through a method for manufacturing a package from a package sleeve made of a composite material. The method comprises the following steps: a) Providing a package sleeve b) folding back the sleeve surface of the package sleeve along both secondary fold lines. The method can be supplemented with the following steps, which are carried out after step a) and after step b): c) sealing the package sleeve in the region of the base surfaces; d) filling the package; e) sealing the package sleeve in the region of the gable surface.

As already described above, the method is also based on the idea of manufacturing a package from a package sleeve the secondary fold edges of which do not form edges of the package produced from this. This is made possible in that the package sleeve, folded along secondary fold lines, is "folded back", whereby the folding along the secondary fold lines is reversed. The secondary fold lines provided in the package sleeve thus do not form edges of the package. This allows the manufacture of packages with complex geometry.

Finally, according to a further embodiment of the method, after being folded back the partial areas of the sleeve surface adjoining the secondary fold lines lie in an angular range between 160° and 200°, in particular between 170° and 190° relative to one another. The partial areas of the sleeve surface should thus be folded back along the secondary fold lines so far that the sleeve surface has virtually continuous transitions between the partial areas of the sleeve surface.

BRIEF DESCRIPTION OF THE DRAWINGS

The invention is explained in more detail in the following with reference to a drawing which simply represents a preferred exemplary embodiment. In the drawing:

FIG. 2F: shows a first embodiment of a package according to the invention which is formed from the package sleeve shown in FIG. 2B after welding, FIG. 2F': shows a first embodiment of a package according to the invention which is formed from the package sleeve shown in FIG. 2B after welding, FIG. 2G: shows the package from FIG. 2F with folded-in lugs, FIG. 2G': shows the package from FIG. 2F' with folded-in fin seam.

DESCRIPTION OF THE INVENTION

Figure 1A:
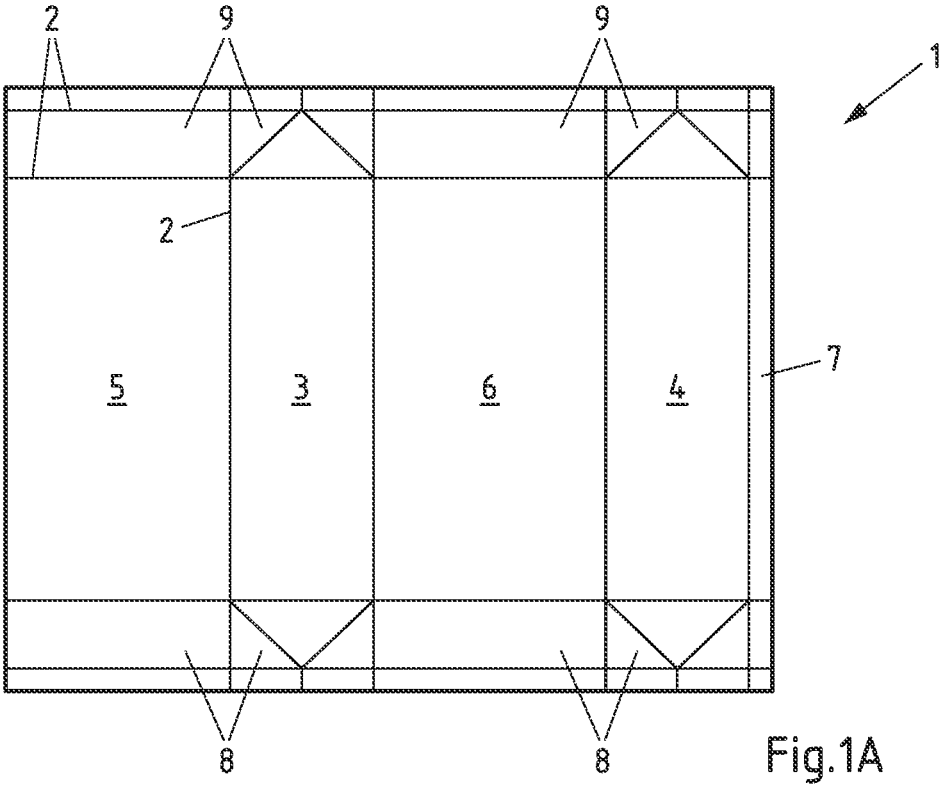
Fig.1A Prior Art
FIG. 1A: shows a sleeve blank intended for folding into a package sleeve known from the prior art.

FIG. 1A shows a sleeve blank 1, known from the prior art, from which a package sleeve can be formed. The sleeve blank 1 can comprise several layers of different materials, for example paper, paperboard, plastic or metal, in particular aluminium. The sleeve blank 1 has several fold lines 2 which are intended to facilitate the folding of the sleeve blank 1 and which divide the sleeve blank 1 into several surfaces. The sleeve blank 1 can be divided into a first side surface 3, a second side surface 4, a front surface 5, a rear surface 6, a sealing surface 7, base surfaces 8 and gable surfaces 9. A package sleeve can be formed from the sleeve blank 1 in that the sleeve blank 1 is folded such that the sealing surface 7 can be connected, in particular welded, with the front surface 5.

Figure 1B:
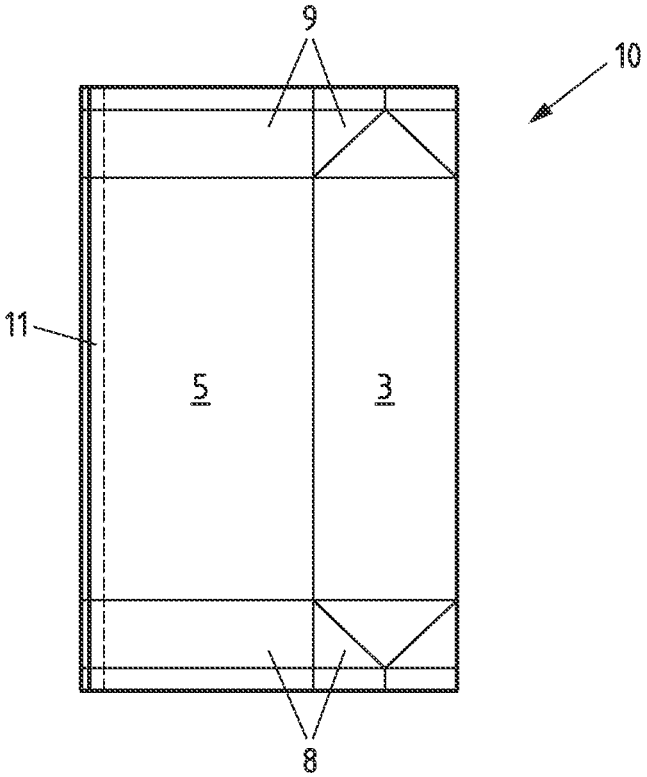
Fig.1B Prior Art
FIG. 1B: shows a package sleeve known from the prior art, formed from the sleeve blank shown in FIG. 1A, in the flat folded state.

FIG. 1B shows a package sleeve 10 known from the prior art in the flat folded state. The regions of the package sleeve already described in connection with FIG. 1A are provided with corresponding reference numbers in FIG. 1B. The package sleeve 10 is formed from the sleeve blank 1 shown in FIG. 1A. For this purpose, the sleeve blank 1 has been folded such that the sealing surface 7 and the front surface 5 are arranged so as to overlap, so that the two surfaces can be surface-welded together. As a result, a longitudinal seam 11 is created. FIG. 1B shows the package sleeve 10 in a flat folded-up state. In this state, a side surface 4 (concealed in FIG. 1B) lies beneath the front surface 5 while the other side surface 3 lies on the rear surface 6 (concealed in FIG. 1B). In the flat folded-up state, several package sleeves 10 can be stacked in a particularly space-saving manner. Therefore, the package sleeves 10 are frequently stacked at the place of manufacture and transported in stacked form to the location where filling takes place. Only there are the package sleeves 10 unstacked and unfolded so that they can be filled with contents, for example with foodstuffs. The filling can take place under aseptic conditions.

Figure 1C:
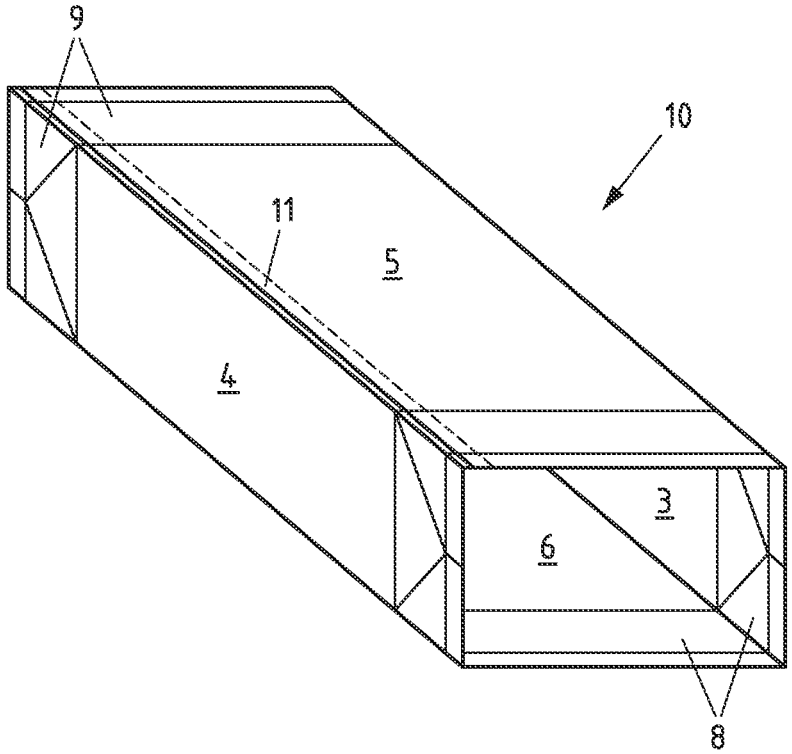
Fig.1C Prior Art
FIG. 1C: shows the package sleeve from FIG. 1B in the unfolded state.

FIG. 1C shows the package sleeve 10 from FIG. 1B in the unfolded state. Here too, the regions of the package sleeve 10 already described in connection with FIG. 1A or FIG. 1B are provided with corresponding reference numbers. The unfolded state refers to a configuration in which an angle of around 90° is formed between the two in each case adjacent surfaces 3, 4, 5, 6, so that the package sleeve 10 assumes a square or rectangular cross section, depending of the shape of these surfaces. Accordingly, the opposite side surfaces 3, 4 are arranged parallel to one another. The same applies to the front surface 5 and the rear surface 6.

Figure 1D:
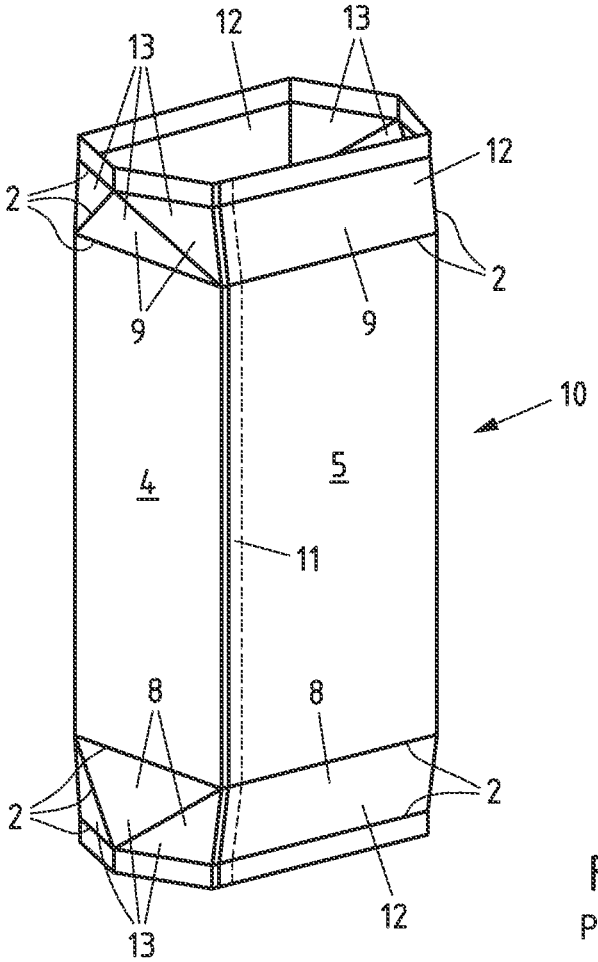
Fig.1D Prior Art
FIG. 1D: shows the package sleeve from FIG. 1C with pre-folded base and gable surfaces.

FIG. 1D shows the package sleeve 10 from FIG. 1C in the pre-folded state, i.e. in a state in which the fold lines 2 have been pre-folded both in the region of the base surfaces 8 as well as in the region of the gable surfaces 9. Those regions of the base surfaces 8 and the gable surfaces 9 which adjoin the front surface 5 and the rear surface 6 are also referred to as rectangular surfaces 12. The rectangular surfaces 12 are folded inwards during the pre-folding and later form the base or the gable of the package. Those regions of the base surfaces 8 and the gable surfaces 9 which adjoin the side surfaces 3, 4 are, in contrast, referred to as triangular surfaces 13. The triangular surfaces 13 are folded outwards during the pre-folding and form projecting regions of surplus material which are also referred to as "lugs" 14 and in a later manufacturing step are folded and fixed against the package, for example using an adhesive bonding process.

Figure 1E:
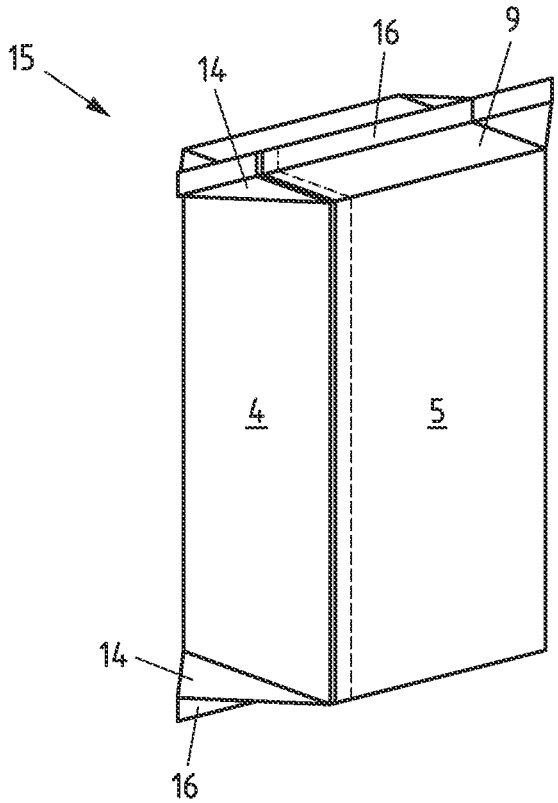
Fig.1E Prior Art
FIG. 1E: shows a package, known from the prior art, which is formed from the sleeve blank shown in FIG. 1A, after welding.

FIG. 1E shows a package 15 known from the prior art which is formed from the sleeve blank shown in FIG. 1A. The package 15 is shown after welding, i.e. in the filled and sealed state. After sealing, a fin seam 16 is created in the region of the base surfaces 8 and in the region of the gable surfaces 9. In FIG. 1E the lugs 14 and the fin seam 16 project. Both the lugs 14 and also the fin seam 16 are folded flat in a later manufacturing step, for example by means of a welding process, in particular one comprising activation and pressing.

Figure 1F:
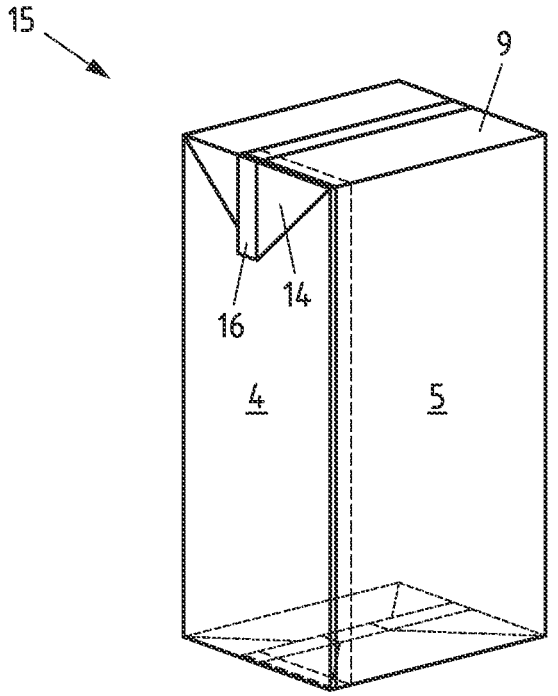
Fig.1F Prior Art
FIG. 1F: shows the package from FIG. 1E with folded-in lugs.

FIG. 1F shows the package 15 from FIG. 1E with folded-in lugs 14. Moreover, the fin seams 16 are also folded flat against the package 15. The upper lugs 14 arranged in the region of the gable surface 9 are folded downwards and fixed flat against the two side surfaces 3, 4. Preferably, the upper lugs 14 are adhesively bonded or welded to the two side surfaces 3, 4. The lower lugs 14 arranged in the region of the base surface 8 are folded downwards, but are fixed flat against the underside of the package 15, which is formed by two rectangular surfaces 12 of the base surface 8. Preferably, the lower lugs 14 are also adhesively bonded or welded together with the package 15—in particular with the rectangular surfaces 12.

Figure 2A:
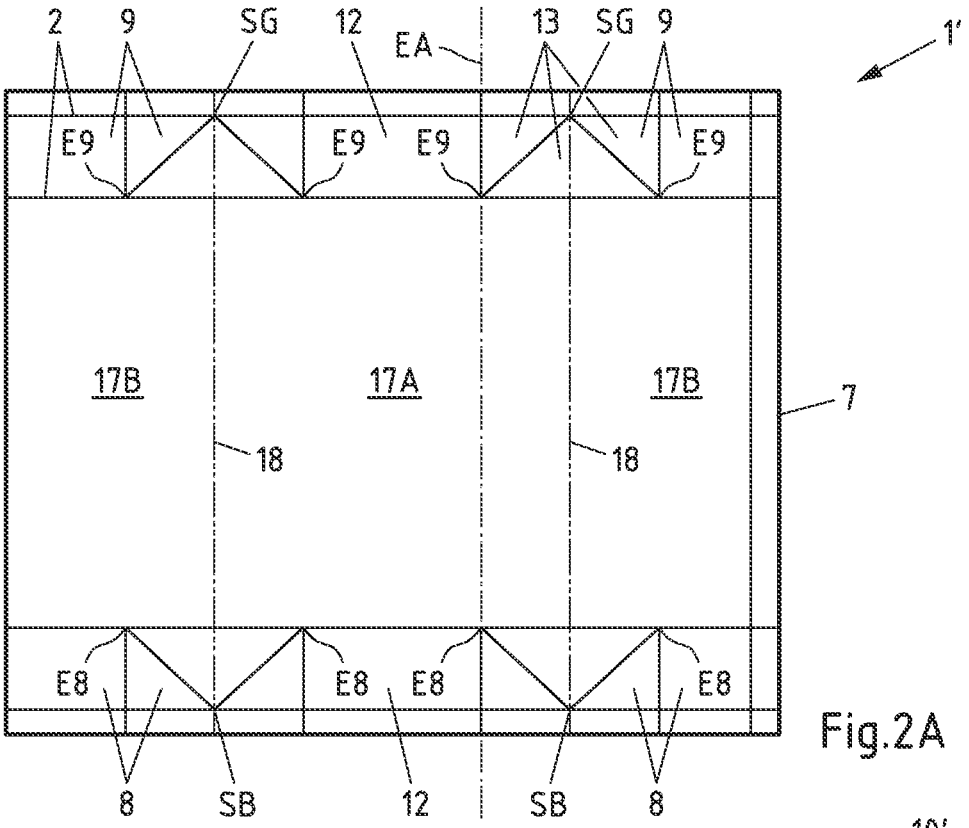
FIG. 2A: shows a sleeve blank for manufacturing a first embodiment of a package sleeve according to the invention.

FIG. 2A shows a sleeve blank 1' for manufacturing a first embodiment of a package sleeve according to the invention. The regions of the sleeve blank already described in connection with FIG. 1A to FIG. 1F are provided with corresponding reference numbers in FIG. 2A. The base surface 8 and the gable surface 9 are unchanged in the sleeve blank 1' in comparison with the sleeve blank 1 from FIG. 1A. However, one difference is that the two side surfaces 3, 4, of the front surface 5 and the rear surface 6 are combined to form a single sleeve surface 17. Apart from the sealing surface 7, the sleeve surface 17 extends over the entire width of the sleeve blank 1'. A further difference is that the sleeve blank 1' contains two secondary fold lines 18 in the region of the sleeve surface 17. The two secondary fold lines 18 are straight and run parallel to one another. Moreover, the secondary fold lines 18 run through a point of contact SB of three adjacent triangular surfaces 13 of the base surface 8 and through a point of contact SG of three adjacent triangular surfaces 13 of the gable surfaces 9. The sleeve surface 17 is divided by the secondary fold lines 18 into an inner partial area 17A and two outer partial areas 17B. The inner partial area 17A lies between two secondary fold lines 18 and the outer partial areas 17B lie next to and outside of the two secondary fold lines 18.

The base surfaces 8 form four corner points E8 and the gable surfaces 9 form four corner points E9. The corner points E8, E9 represent corner points of the package which is to be produced from the sleeve blank 1'. Each corner point E8 of a base surface 8 is associated with a corresponding corner point E9 of a gable surface 9, which is in each case the corner point E9 which, when the package is standing, is arranged above this corner point E8. A corner axis EA runs through two associated corner points E8, E9 which, in a conventional cuboid package, would correspond to a vertical package edge. Four corner axes EA are therefore present in the sleeve blank 1' shown in FIG. 2A—also in the package sleeve produced from this and the package produced from this package sleeve (for reasons of clarity, only one corner axis EA is in each case drawn in). No fold lines are provided between the corner points E8 of the base surfaces 8 and the corner points E9 of the gable surfaces 9 associated therewith—i.e. along the corner axes EA.

Figure 2B:
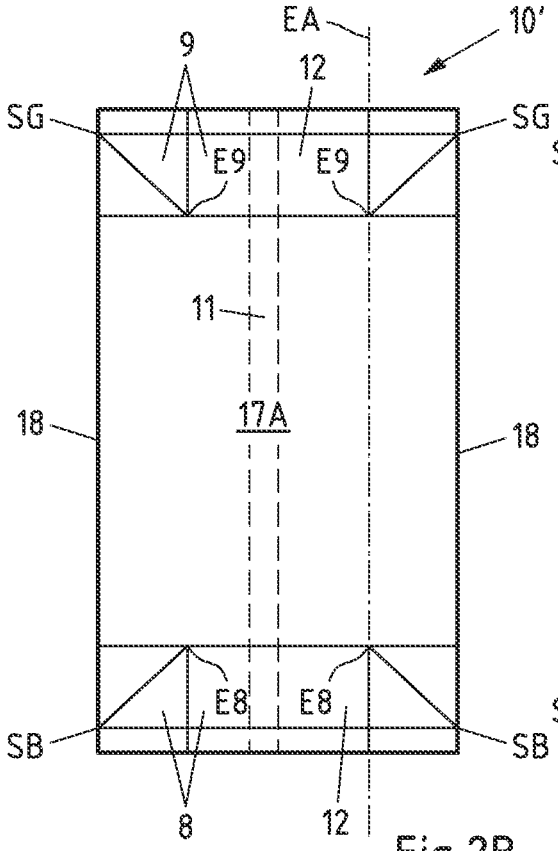
FIG. 2B: shows a first embodiment of a package sleeve according to the invention which is formed from the sleeve blank shown in FIG. 2A in a front view.

FIG. 2B shows a first embodiment of a package sleeve according to the invention 10', which is formed from the sleeve blank 1' shown in FIG. 2A, in a front view. The regions of the package sleeve already described in connection with FIG. 1A to FIG. 2A are provided with corresponding reference numbers in FIG. 2B. The package sleeve 10' has been created from the sleeve blank 1' through two steps: Firstly, the sleeve blank 1' is folded along the two secondary fold lines 18. The two partial areas 17A, 17B of the sleeve surface 17 are then connected with one another, in particular welded together, in the region of the sealing surface 7, creating a longitudinal seam 11 (concealed in FIG. 2B). The package sleeve 1' thus has a circumferential structure, closed in the circumferential direction, with an opening in the region of the base surface 8 and with an opening in the region of the gable surface 9. In the front view, the inner partial area 17A of the sleeve surface 17, which is limited on each side by the secondary fold lines 18, is visible. The other partial areas 17B of the sleeve surface 17 are on the rear side of the package sleeve 10' and are therefore hidden in FIG. 2B.

Figure 2C:
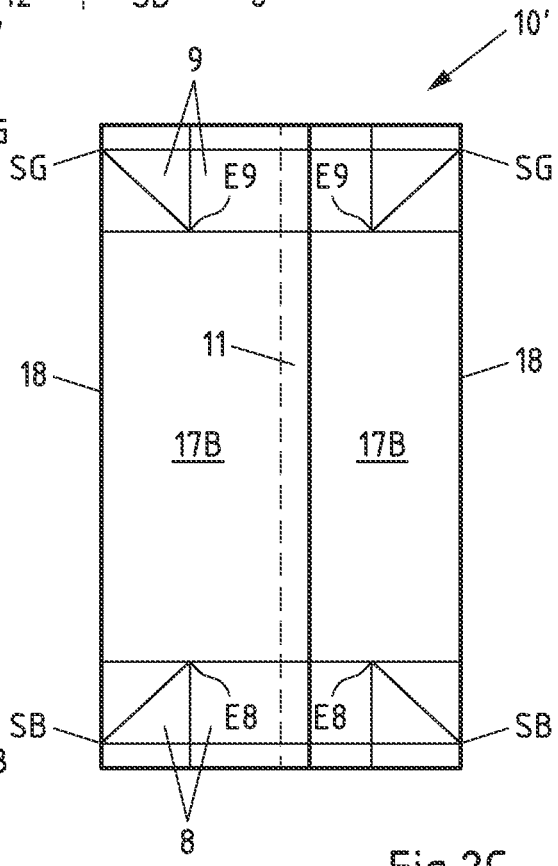
FIG. 2C: shows the package sleeve from FIG. 2B in a rear view.

FIG. 2C shows the package sleeve 1' from FIG. 2B in a rear view. The regions of the package sleeve already described in connection with FIG. 1A to FIG. 2B are provided with corresponding reference numbers in FIG. 2C. In the rear view, the two outer partial areas 17B of the sleeve surface 17 which are connected with one another through the longitudinal seam 11 and which are limited on each side by the secondary fold lines 18 are visible. According to one embodiment, as shown in FIG. 3H, the composite material forming the package sleeve can be stripped in the region of the longitudinal seam 11 by removing a portion of the layers forming the sleeve, as shown by 11A and 11B, resulting in a less pronounced increase in thickness at the seam 11. According to one embodiment, as shown in FIG. 31, the composite material forming the package sleeve can stripped in the region of the longitudinal sleeve and turned or folded over, as shown by 11C and 11D, while still maintaining a less pronounced increase in thickness in the area of the seam 11. The inner partial area 17A of the sleeve surface 17 is on the front side of the package sleeve 10' and is therefore hidden in FIG. 2C.

Figure 2D:
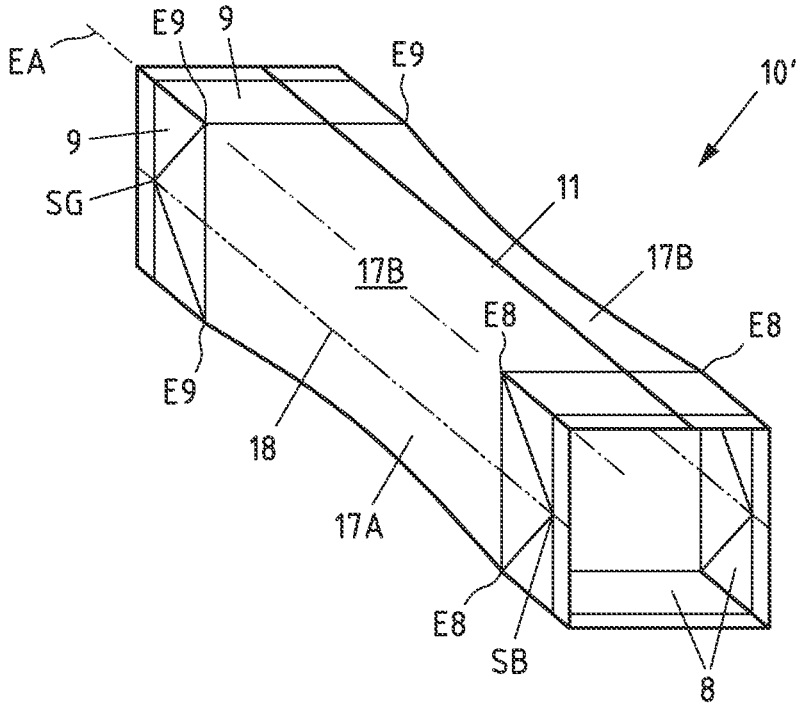
FIG. 2D: shows the package sleeve from FIG. 2B and FIG. 2C in the unfolded state.

FIG. 2D shows the package sleeve 1' from FIG. 2B and FIG. 2C in the unfolded state. The regions of the package sleeve already described in connection with FIG. 1A to FIG. 2C are provided with corresponding reference numbers in FIG. 2D. The unfolded state is achieved by folding back the package sleeve 1' along the secondary fold lines 18 running through the sleeve surface 17. The sleeve is folded back by around 180°. The result of this folding back along the secondary fold lines 18 is that the two partial areas 17A, 17B of the sleeve surface 17 adjoining the secondary fold line 18 no longer lie on top of one another, but are arranged in the same plane. The package sleeve 10' is therefore only folded along the secondary fold lines 18 in its flat state (FIG. 2B, FIG. 2C); in the unfolded state (FIG. 2D), the package sleeve 10' (like the package which is to be formed out of it) is, in contrast, no longer folded along the secondary fold lines 18. Thus the designation as "secondary" fold lines 18.

Figure 2E:
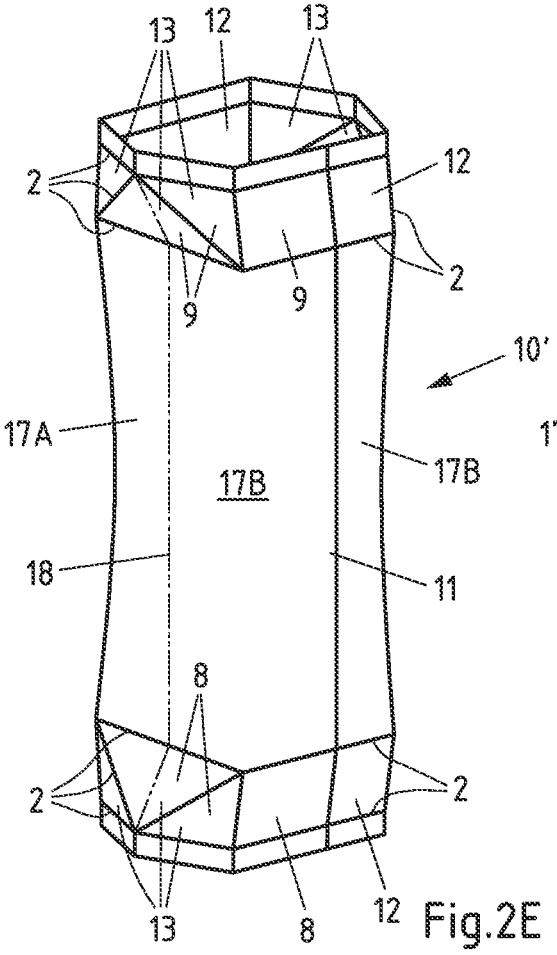
FIG. 2E: shows the package sleeve from FIG. 2D with pre-folded base and gable surfaces, FIG. 2E': shows the package sleeve from FIG. 2D with pre-folded base and gable surfaces.
Figure 2E:
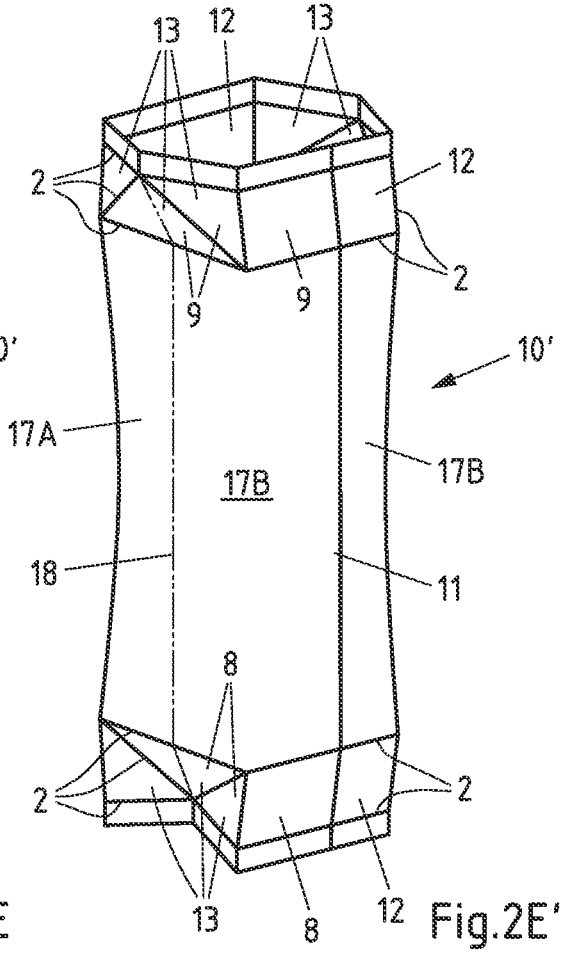

FIG. 2E shows the package sleeve 10' from FIG. 2D with pre-folded base and gable surfaces. The regions of the package sleeve already described in connection with FIG. 1A to FIG. 2D are provided with corresponding reference numbers in FIG. 2E. The pre-folded state refers (as in FIG. 1D) to a state in which the fold lines 2 have been pre-folded, both in the region of the base surfaces 8 as well as in the region of the gable surfaces 9. The rectangular surfaces 12 are folded inwards during the pre-folding and later form the base or the gable of the package. The triangular surfaces 13 are folded outwards during the pre-folding and form projecting regions of surplus material which are also referred to as "lugs" 14 and in a later manufacturing step are folded and fixed against the package, for example using an adhesive bonding process.

FIG. 2E' also shows the package sleeve 10' from FIG. 2D with pre-folded base and gable surfaces, for which reason corresponding reference numbers are also used here. The difference in comparison with FIG. 2E is that the triangular surfaces 13 are not folded outwards, but inwards.

FIG. 2F shows a first embodiment of a package according to the invention 15', which is formed from the package sleeve 10' shown in FIG. 2B, after welding. The regions of the package already described in connection with FIG. 1A to FIG. 2E are provided with corresponding reference numbers in FIG. 2E. The package 15' is shown after welding, i.e. in the filled and sealed state. After sealing, a fin seam 16 is created in the region of the base surfaces 8 and in the region of the gable surfaces 9. In FIG. 2F the lugs 14 and the fin seam 16 project. Both the lugs 14 and also the fin seam 16 are folded flat in a later manufacturing step, for example by means of an adhesive bonding process.

FIG. 2F' also shows a first embodiment of a package according to the invention 15', which is formed from the package sleeve 10' shown in FIG. 2B, after welding. Corresponding reference numbers are therefore also used here. The difference in comparison with FIG. 2F is that the triangular surfaces 13 are not folded outwards prior to welding, but inwards. Therefore, the "lugs" 14 do not project outwards, but extend inwards. This leads to a shorter fin seam 16.

FIG. 2G shows the package 15' from FIG. 2F with folded-in lugs 14. The regions of the package already described in connection with FIG. 1A to FIG. 2F are provided with corresponding reference numbers in FIG. 2G. As well as the lugs 14, the fin seams 16 are also folded against the package 15'. The upper lugs 14 arranged in the region of the gable surface 9 are folded downwards and laid flat against the sleeve surface 17. Preferably, the upper lugs 14 are adhesively bonded or welded to the sleeve surface 17. The lower lugs 14 arranged in the region of the base surface 8 are folded downwards, but are fixed flat against the underside of the package 15', which is formed by two rectangular surfaces 12 of the base surface 8. Preferably, the lower lugs 14 are also adhesively bonded or welded together with the package 15'—in particular with the rectangular surfaces 12. In the package 15' illustrated in FIG. 2G, while the sleeve surface 17 is curved, it does not contain any fold edges in the region of the sleeve surface 17.

FIG. 2G' shows the package 15' from FIG. 2F' with folded-in fin seam 16. Corresponding reference numbers are therefore also used here. The fin seam 16 is folded over and laid flat against the underside of the package 15', which is formed through two rectangular surfaces 12 of the base surface 8. Preferably, the fin seam 16 is adhesively bonded or welded with the package 15'—in particular with a rectangular surface 12. The difference in comparison with FIG. 2G lies in the structure of the base of the package 15': In FIG. 2G the lugs 14 are arranged beneath the rectangular surfaces 12 and are thus visible from the underside; in FIG. 2G', in contrast, the rectangular surfaces 12 are arranged beneath the lugs 14 and are thus visible from the underside.

Figure 3A:
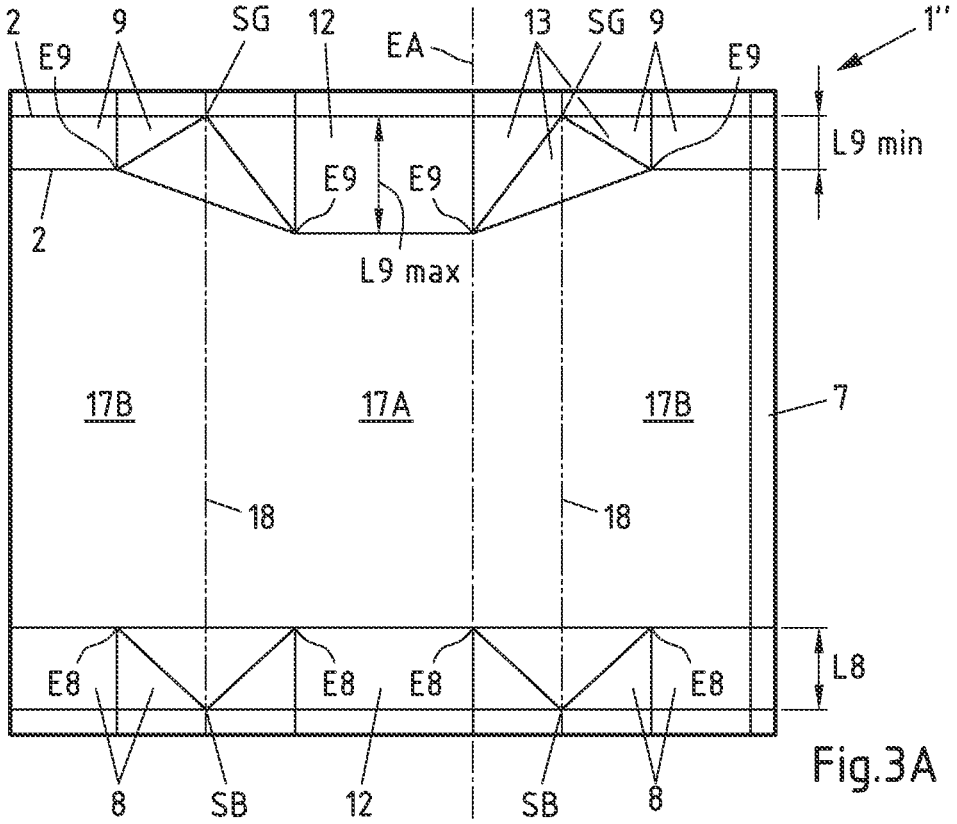
FIG. 3A: shows a sleeve blank for manufacturing a second embodiment of a package sleeve according to the invention.

FIG. 3A shows a sleeve blank 1" for manufacturing a second embodiment of a package sleeve according to the invention. The sleeve blank 1" in FIG. 3A largely corresponds to the sleeve blank 1' in FIG. 2A, so that corresponding reference numbers are also used here. One difference lies in the form of the gable surface 9: whereas the length L8 of the base surface 8 is constant over the entire width of the sleeve blank 1", the length of the gable surface 9 has different values. Adjacent to the outer partial areas 17B of the sleeve surface 17, the gable surface 9 has a reduced length $L9_{min}$. In contrast, adjacent to the inner partial area 17A of the sleeve surface 17, the gable surface 9 has an increased length $L9_{max}$. This design means that the inner partial area 17A has a lower height than the outer partial areas 17B. Also in the case of the sleeve blank 1", the sleeve blank 1" contains two secondary fold lines 18 in the region of the sleeve surface 17. The two secondary fold lines 18 are straight and run parallel to one another. Moreover, the secondary fold lines 18 run through a point of contact SB of three adjacent triangular surfaces 13 of the base surface 8 and through a point of contact SG of three adjacent triangular surfaces 13 of the gable surfaces 9.

Figure 3B:
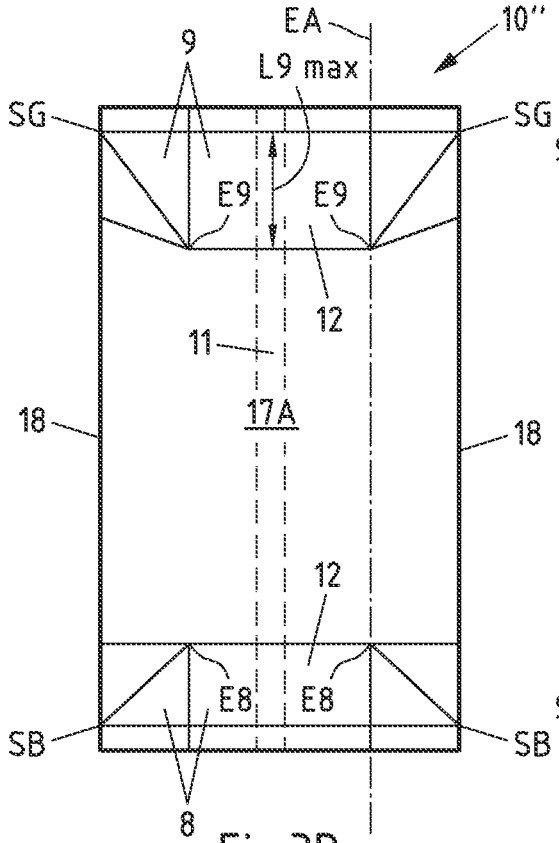
FIG. 3B: shows a second embodiment of a package sleeve according to the invention which is formed from the sleeve blank shown in FIG. 3A in a front view.

FIG. 3B shows a second embodiment of a package sleeve according to the invention 10", which is formed from the sleeve blank 1" shown in FIG. 3A, in a front view. The package sleeve 10" in FIG. 3B largely corresponds to the package sleeve 10' in FIG. 2B, so that corresponding reference numbers are also used here. One difference lies in the increased length $L9_{max}$ of the gable surface 9 in its region adjoining the front partial area 17A of the sleeve surface 17.

Figure 3C:
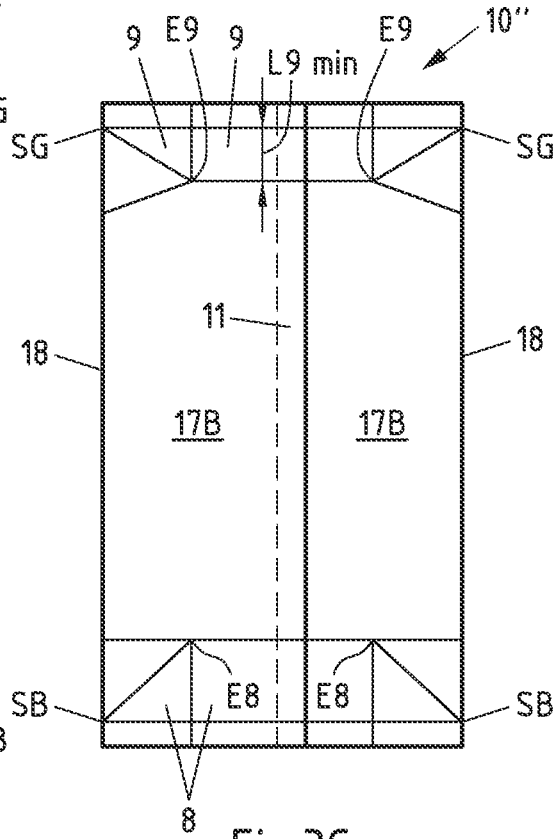
FIG. 3C: shows the package sleeve from FIG. 3B in a rear view.

FIG. 3C shows the package sleeve 10" from FIG. 3B in a rear view. The package sleeve 10" in FIG. 3C largely corresponds to the package sleeve 10' in FIG. 2C, so that corresponding reference numbers are also used here. One difference lies in the reduced length $L9_{min}$ of the gable surface 9 in its region adjoining the outer partial areas 17B of the sleeve surface 17.

Figure 3D:
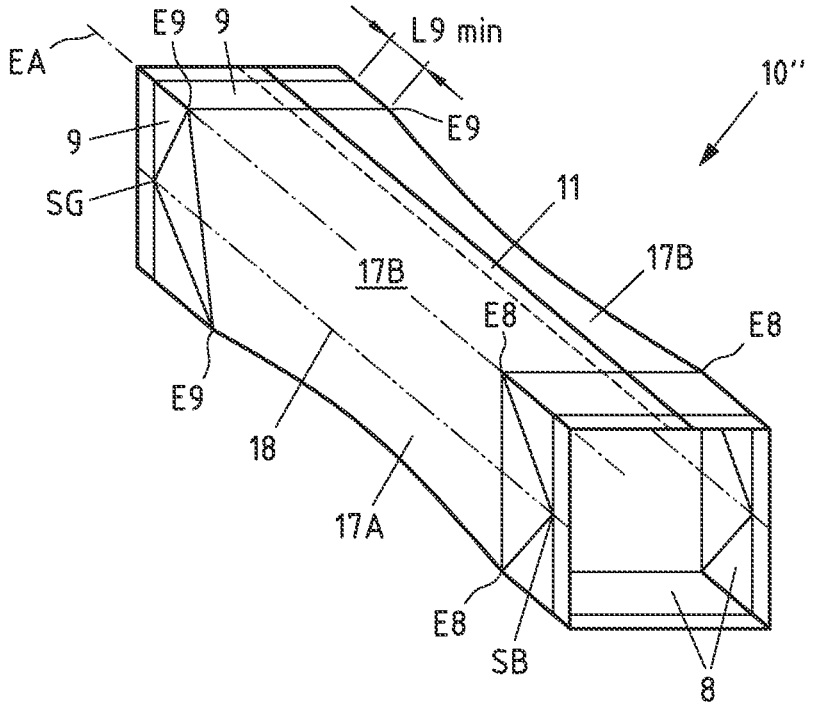
FIG. 3D: shows the package sleeve from FIG. 3B and FIG. 3C in the unfolded state.

FIG. 3D shows the package sleeve 10" from FIG. 3B and FIG. 3C in the unfolded state. The package sleeve 10" in FIG. 3D largely corresponds to the package sleeve 10' in FIG. 2D, so that corresponding reference numbers are also used here. One difference lies in the increased length $L9_{max}$ of the gable surface 9 in its region adjoining the inner partial area 17A of the sleeve surface 17 as well as in the reduced length $L9_{min}$ of the gable surface 9 in its region adjoining the outer partial areas 17B of the sleeve surface 17.

Figure 3E:
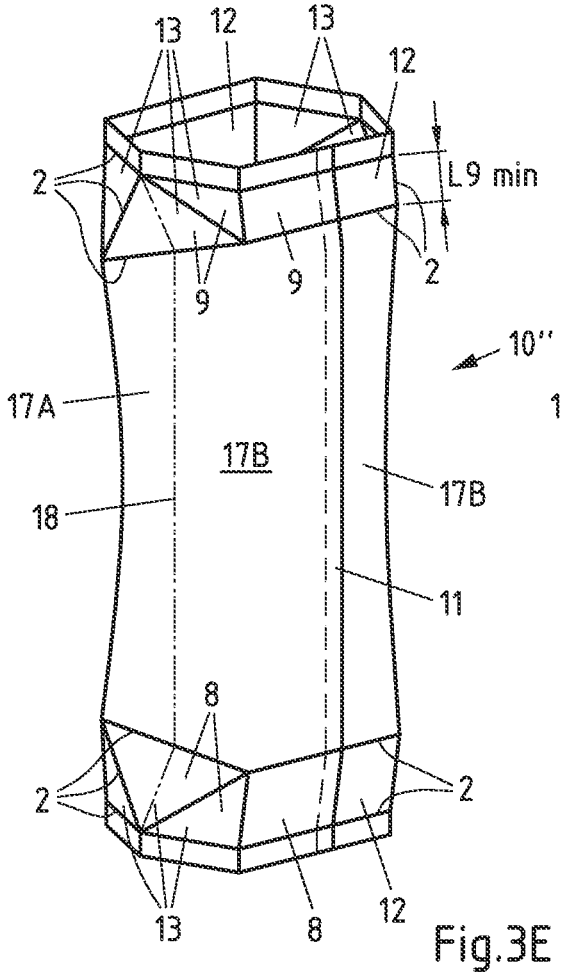
FIG. 3E: shows the package sleeve from FIG. 3D with pre-folded base and gable surfaces, FIG. 3E': shows the package sleeve from FIG. 3D with pre-folded base and gable surfaces.
Figure 3E:
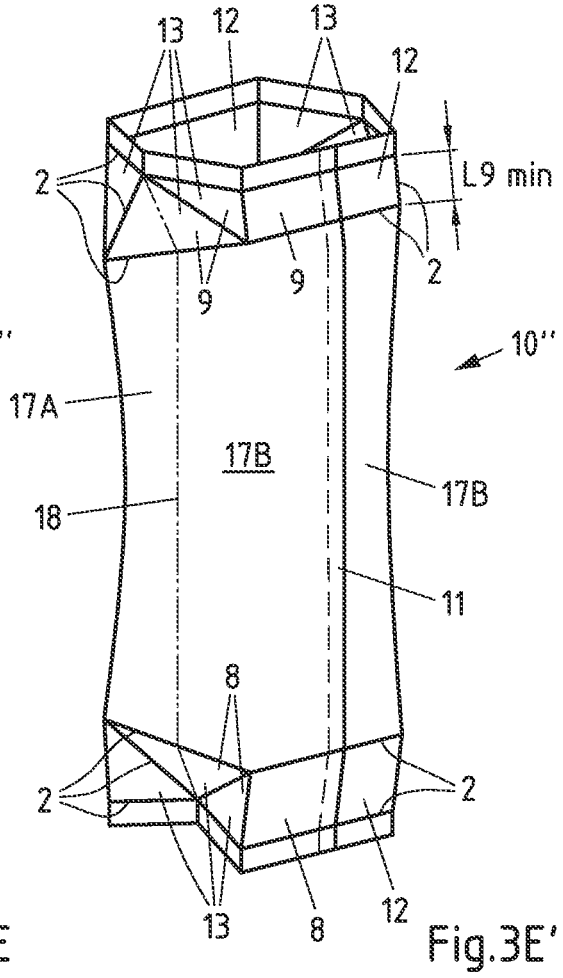

FIG. 3E shows the package sleeve 10" from FIG. 3D with pre-folded base and gable surfaces. The package sleeve 10" in FIG. 3E largely corresponds to the package sleeve 10' in FIG. 2E, so that corresponding reference numbers are also used here. One difference lies in the increased length $L9_{max}$ of the gable surface 9 in its region adjoining the inner partial area 17A of the sleeve surface 17 as well as in the reduced length $L9_{min}$ of the gable surface 9 in its region adjoining the outer partial areas 17B.

FIG. 3E' also shows the package sleeve 10" from FIG. 3D with pre-folded base and gable surfaces, for which reason corresponding reference numbers are also used here. The difference in comparison with FIG. 3E is that the triangular surfaces 13 are not folded outwards, but inwards.

Figure 3F:
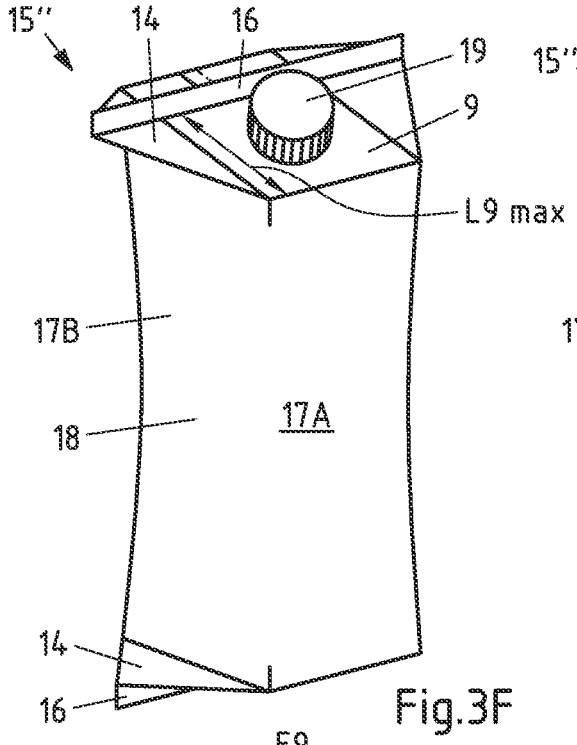
FIG. 3F: shows a second embodiment of a package according to the invention which is formed from the package sleeve shown in FIG. 3B after welding, FIG. 3F': shows a second embodiment of a package according to the invention which is formed from the package sleeve shown in FIG. 3B after welding.
Figure 3F:
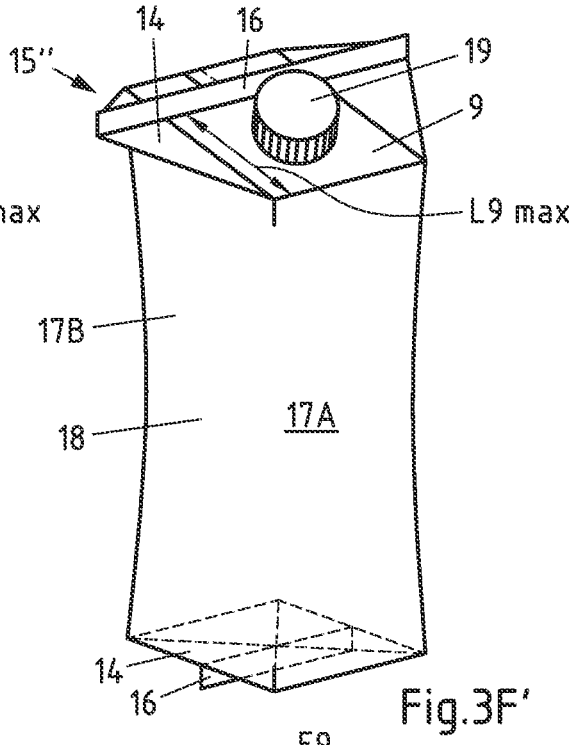

FIG. 3F shows a second embodiment of a package according to the invention 15", which is formed from the package sleeve 10" shown in FIG. 3B, after welding. The package 15" in FIG. 3F largely corresponds to the package 15' in FIG. 2F, so that corresponding reference numbers are also used here. One difference lies in the increased length $L9_{max}$ of the gable surface 9 in its region adjoining the inner partial area 17A of the sleeve surface 17 as well as in the reduced length $L9_{min}$ of the gable surface 9 in its region adjoining the outer partial areas 17B of the sleeve surface 17. The increased length $L9_{max}$ of the gable surface 9 leads to a large surface which can be used for a pouring element 19.

FIG. 3F' also shows a second embodiment of a package according to the invention 15", which is formed from the package sleeve 10" shown in FIG. 3B, after welding. Corresponding reference numbers are therefore also used here. The difference in comparison with FIG. 3F is that the triangular surfaces 13 were not folded outwards, but inwards prior to welding. Therefore, the "lugs" 14 do not project outwards, but extend inwards. This leads to a shorter fin seam 16.

Figure 3G:
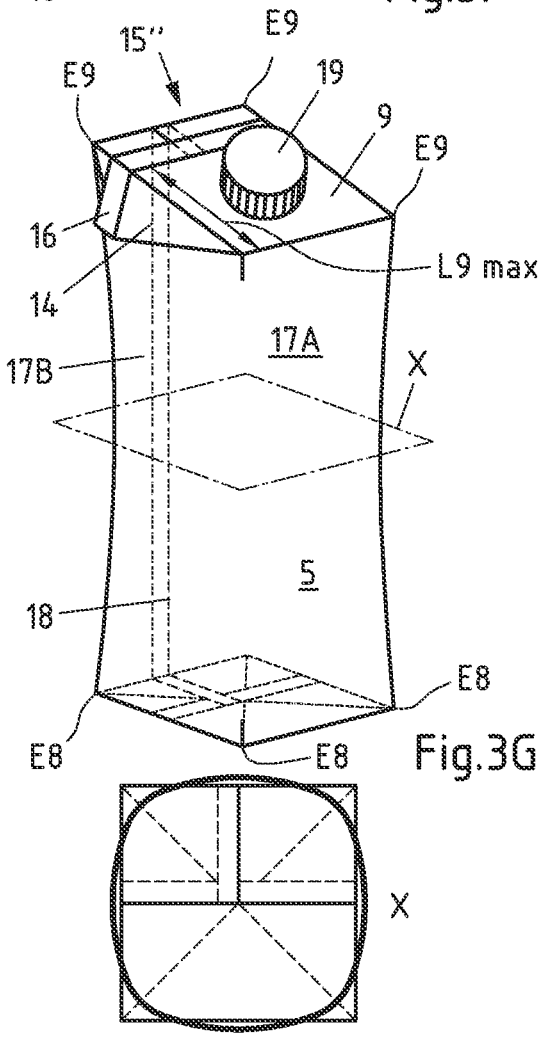
FIG. 3G: shows the package from FIG. 3F with folded-in lugs, and FIG. 3G': shows the package from FIG. 3F' with folded-in fin seam.
Figure 3G:
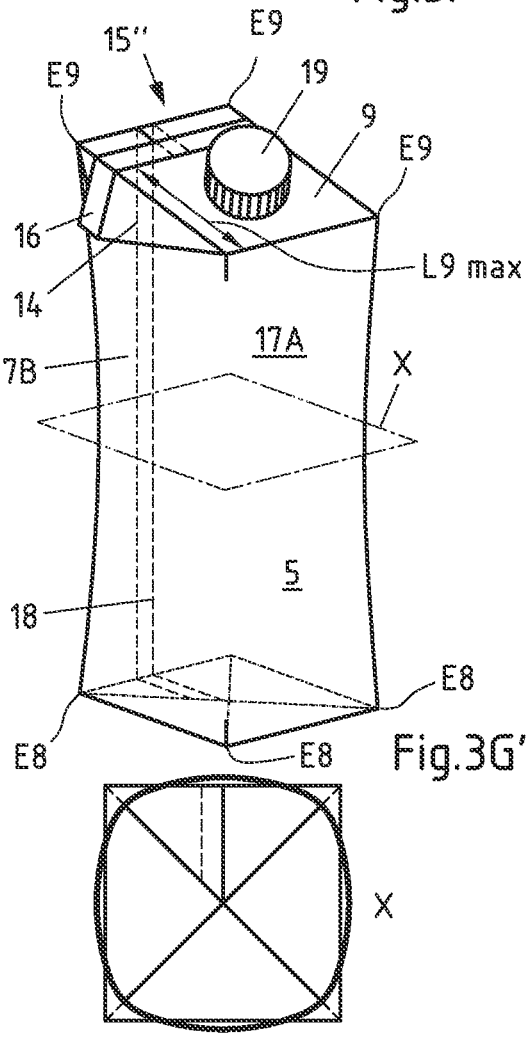
Figure 3H:
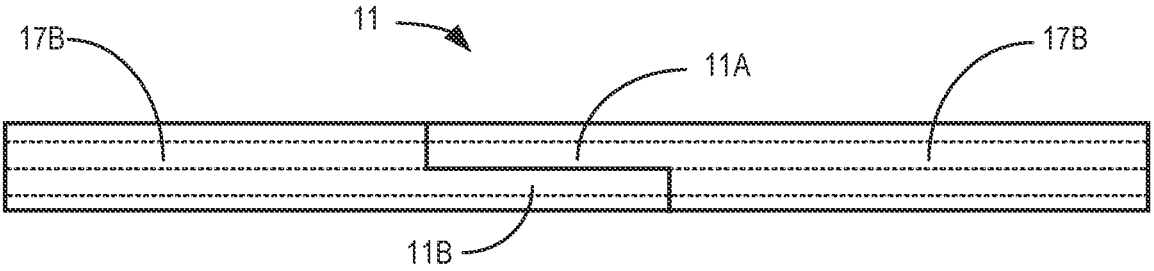
FIG. 3H shows a cross-sectional view of the seam 11 of FIG. 2C and/or FIG. 3C
Figure 3I:
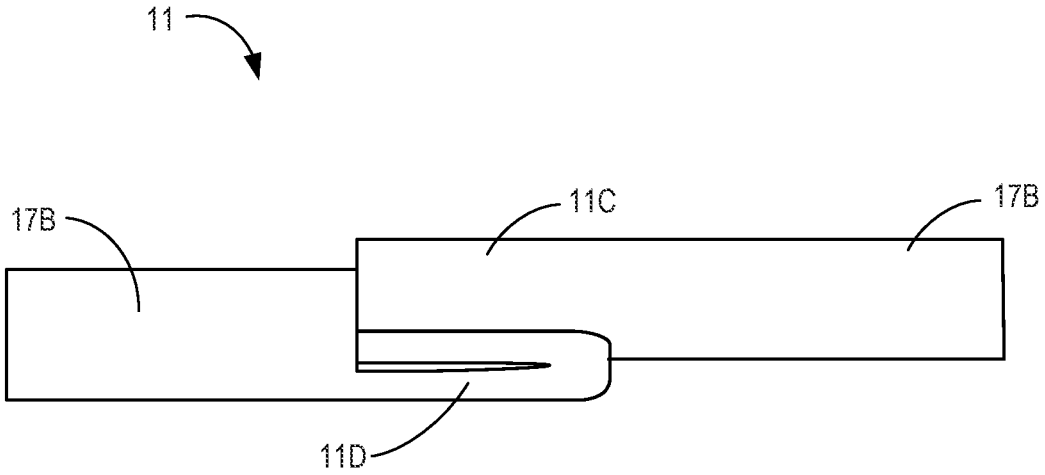
FIG. 3I shows a cross-sectional view of the seam 11 of FIGS. 2C and/or FIG. 3C in a folded over configuration.

Finally, FIG. 3G shows the package 15" from FIG. 3F with folded-in lugs 14. The package 15" in FIG. 3G largely corresponds to the package 15' in FIG. 2G, so that corresponding reference numbers are also used here. One difference lies in the increased length $L9_{max}$ of the gable surface 9 in its region adjoining the inner partial area 17A of the sleeve surface 17 as well as in the reduced length $L9_{min}$ of the gable surface 9 in its region adjoining the outer partial areas 17B of the sleeve surface 17. The increased length $L9_{max}$ of the gable surface 9 leads to a large surface which can be used for a pouring element 19. Due to the downward-sloping upper side of the package 15", such packages are also known as "sloping gable-top packages".

Finally, FIG. 3G' shows the package 15" from FIG. 3F' with folded-in fin seam 16. Corresponding reference numbers are therefore also used here. The fin seam 16 is folded over and laid flat against the underside of the package 15", which is formed by two rectangular surfaces 12 of the base surface 8. Preferably, the fin seam 16 is adhesively bonded or welded with the package 15"—in particular with a rectangular surface 12. The difference in comparison with FIG. 3G lies in the structure of the base of the package 15": in FIG. 3G the lugs 14 are arranged beneath the rectangular surfaces 12 and are thus visible from the underside; in FIG.

3G', in contrast, the rectangular surfaces 12 are arranged beneath the lugs 14 and are thus visible from the underside.

LIST OF REFERENCE NUMERALS

1, 1', 1": sleeve blank
2, 2': fold line
3, 4: side surface
5: front surface
6: rear surface
7: sealing surface
8: base surface
9: gable surface
10, 10', 10": package sleeve
11: longitudinal seam
12: rectangular surface
13: triangular surface
14: lug
15, 15', 15": package
16: fin seam
17: sleeve surface
17A, 17B: partial area (of the sleeve surface 17)
18: secondary fold line
19: pouring element
EA: corner axis
E8: corner point (of the base surface 8)
E9: corner point (of the gable surface 9)
SB: point of contact (of the triangular surfaces 13 of the base surface 8)
SG: point of contact (of the triangular surfaces 13 of the gable surface 9

The invention claimed is:

1. A package sleeve made of a composite material for the manufacture of a package, comprising:

a sleeve surface with an inner partial area and with two outer partial areas, gable surfaces and a material weakening in one of the gable surfaces, for fixing a pouring element, a longitudinal seam which connects two edges of the composite material to form a circumferential package sleeve, and two secondary fold lines, which run through the sleeve surface, wherein the package sleeve is folded along two secondary fold lines, wherein apart from the two secondary fold lines, the package sleeve does not contain any further continuous fold lines in the region of the inner partial area of the sleeve surface, wherein the composite material includes at least one layer of paper or paperboard which includes on the edge of the longitudinal seam running within the package sleeve a liquid-tight covering to prevent leaking, contamination, and contact between contents of a resultant package and the at least one paper or paperboard layer, and wherein the composite material is stripped to include fewer layers as compared to non-stripped composite material in the region of the longitudinal seam, and wherein the at least one layer of paper or paperboard is covered by turning over the composite material in the region of the longitudinal seam, the package sleeve further comprising base surfaces and, wherein the gable surfaces are arranged on opposite sides of the sleeve surface, and wherein the gable surface on a rear side of the package sleeve has a shorter length than the length of the gable surface on a front side of the package sleeve.

2. The package sleeve according to claim 1, wherein the package sleeve is folded flat along both secondary fold lines by an angle of in each case around 180°.

3. The package sleeve according to claim 1, wherein the two secondary fold lines run parallel to one another.

4. The package sleeve according to claim 1, wherein the base surfaces and the gable surfaces in each case comprise two rectangular surfaces and six triangular surfaces.

5. The package sleeve according to claim 4, wherein the secondary fold lines run through the point of contact of three adjacent triangular surfaces of the base surface and through the point of contact of three adjacent triangular surfaces of the gable surface.

6. The package sleeve according to claim 1, wherein the secondary fold lines are stamped from the inner side to the outer side of the package sleeve and/or from the outer side to the inner side of the package sleeve.

7. The package sleeve according to claim 1, wherein the composite material of the package sleeve has a weight in the range between 150 $g/m^2$ and 400 $g/m^2$.

8. The package sleeve according to claim 1, wherein the package sleeve is open both in the region of the base surfaces and in the region of the gable surfaces.

9. A package made of a composite material, wherein the package is made from a package sleeve according to claim 1, and wherein the package is sealed in the region of the base surfaces and in the region of the gable surfaces, wherein the package does not contain any continuous straight fold edges in the region of the inner partial area of the sleeve surface.

10. The package according to claim 9, wherein the partial areas of the sleeve surface adjoining the secondary fold lines are in each case arranged in an angular range between 160° and 200°, in particular between 170° and 190° relative to one another.

11. The package according to claim 9, further comprising lugs which are laid against the base surfaces in the lower region of the package.

12. The package according to claim 9, further comprising lugs which are laid against the sleeve surface in the upper region of the package.

* * * * *